US007053791B2

(12) United States Patent
Kazmierczak

(10) Patent No.: US 7,053,791 B2
(45) Date of Patent: May 30, 2006

(54) INDUCTIVE TRANSFORMER

(75) Inventor: Harald Kazmierczak, Beilstein (DE)

(73) Assignee: Robert Bosch GmbH, Stuttgart (DE)

( * ) Notice: Subject to any disclaimer, the term of this patent is extended or adjusted under 35 U.S.C. 154(b) by 605 days.

(21) Appl. No.: 10/380,594

(22) PCT Filed: Aug. 28, 2001

(86) PCT No.: PCT/DE01/03269

§ 371 (c)(1),
(2), (4) Date: Mar. 17, 2003

(87) PCT Pub. No.: WO02/25616

PCT Pub. Date: Mar. 28, 2002

(65) Prior Publication Data

US 2003/0179105 A1 Sep. 25, 2003

(30) Foreign Application Priority Data

Sep. 20, 2000 (DE) ..... 100 46 659

(51) Int. Cl.
*H01F 21/04* (2006.01)
*G08C 19/12* (2006.01)

(52) U.S. Cl. ..... 340/870.31; 336/115

(58) Field of Classification Search ..... 340/870.31; 336/115, 117, 130, 136
See application file for complete search history.

(56) References Cited

U.S. PATENT DOCUMENTS 6,650,216 B1 * 11/2003 Kazmierczak ..... 336/117

FOREIGN PATENT DOCUMENTS

| | | |
|---|---|---|
| DE | 38 02 062 A1 | 8/1988 |
| DE | 195 38 528 A1 | 4/1997 |
| GB | 2 173 351 A | 10/1986 |
| WO | 97/38876 | 10/1997 |

* cited by examiner

*Primary Examiner*—Michael Horabik
*Assistant Examiner*—Kimberly Jenkins
(74) *Attorney, Agent, or Firm*—Michael J. Striker

(57) ABSTRACT

The invention relates to an inductive transmitter for transmitting measurement data and electrical energy between two components (1, 2) that move in relation to each other, having at least one primary (3, 5) and at least one secondary transmitter component (4, 6). There is one transmitter (3, 4) for transmitting measurement data and one transmitter (5, 6) for transmitting electrical energy, with the primary (3, 5) and secondary (4, 6) transmitter components being disposed in separate chambers (7, 8) that are magnetically shielded from each other to a large extent. The chambers (7, 8) are formed on the components by concentric, radial metal walls of the chamber elements (1, 2), with the concentric walls extending into each other in such a way that they form chambers (7, 8) situated radially one behind the other.

4 Claims, 1 Drawing Sheet

INDUCTIVE TRANSFORMER

BACKGROUND OF THE INVENTION

The invention relates to an inductive transmitter, in particular a rotating transmitter, for signal and energy transmission between moving components.

Especially when used in a motor vehicle, such a transmitter should permit for example, bi-directional data transmission between the steering column and the steering wheel, with simultaneous energy transmission from the steering column to the steering wheel. The transmission of energy can be approximately 1 W if only the steering wheel electronics need to be supplied, with an additional 120 W if a steering wheel heater must be supplied as well. Moreover, it is also possible for information to be exchanged regarding the activation of the horn, control buttons for driving comfort, a telephone dialing button, speed regulation (cruise control), certain radio functions, or even monitoring or activation of the air bag.

Conventionally, in such cases, a coiled spring is provided for data transmission and/or a slip ring for energy transmission. However, the coiled spring and slip ring tend by nature to have a relatively high noise level and, at the same time, cause a multitude of problems, such as so-called EMC problems (EMC=electromagnetic compatibility), installation and repair problems, as well as a non-negligible amount of friction and difficulty in producing contact. If the inductive transmission of electrical energy is executed at the same time as data transmission, this may result in cross-talk, particularly since the transmitter has an efficiency of <0.6 and the internal resistance of the secondary side is >15 ohm.

SUMMARY OF THE INVENTION

According to the invention, an inductive transmitter for transmitting measurement data and electrical energy between two components that move in relation to each other, having one primary and one secondary transmitter component, is improved in an advantageous manner. According to the invention, there is one transmitter for transmitting measurement data and one transmitter for transmitting electrical energy. The primary and secondary transmitter components of each transmitter are contained in separate chambers that are magnetically shielded from each other to a large extent and that are formed onto the moving components as concentric, radial metal walls, with the concentric walls extending into each other in such a way that they form chambers situated radially one behind the other.

Thus, it is possible for a metallic chamber element to be disposed in a simple manner on each of the components that move in relation to each other, which chamber elements each have a double U-shape in a radial cross section and whose concentric walls are arranged so that they extend into each other without hindering the rotational movement. It is preferable for this to be applied in such a way that the one set of transmitter components and chamber elements is disposed on the steering shaft of a vehicle and the other set of transmitter components and chamber elements is disposed on the steering column of a vehicle.

The recommended arrangement of two transmitters separated by chamber walls allows the mixture of signal and energy transmission to be prevented in a simple manner. Although the partition in the middle between the two chamber elements does serve as the magnetic component for both components of the transmitter, it does not produce any significant cross-talk because at the frequencies of 50 kHz or a few megahertz that are used in most applications, for example in a motor vehicle, only a magnetic skin effect occurs and the magnetic interactions do not have a disruptive effect.

These and other characteristics of preferred embodiments of the invention can be found in the specification and drawings as well as in the claims, and the individual characteristics that may be realized, alone or together in the form of ancillary combinations, in the embodiments of the invention and in other fields, and that may be considered advantageous and intrinsically patentable embodiments, are hereby included in this application.

BRIEF DESCRIPTION OF THE DRAWINGS

One exemplary embodiment of an inductive transmitter according to the invention for signal and energy transmission between components of a rotating transmitter will be explained in detail below with reference to the drawings.

DESCRIPTION OF THE PREFERRED EMBODIMENTS

Figure 1:
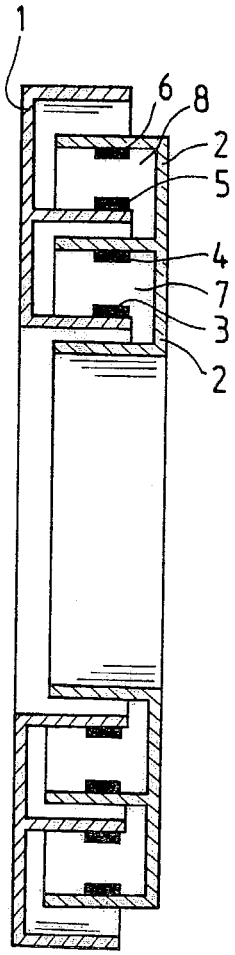
FIGS. 1 and 2 each show a view of a rotating transmitter between a steering shaft and a steering column of a motor vehicle, with separate transmitter components for signal and energy transmission, each in separate chambers.
Figure 2:
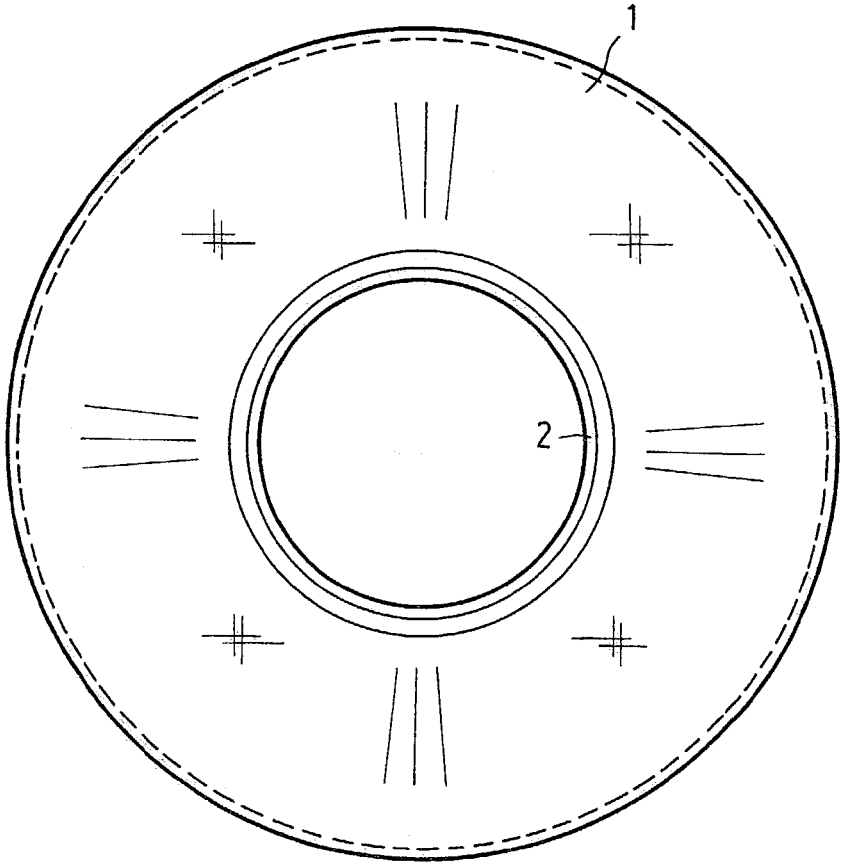

FIG. 1 shows an inductive transmitter having chamber elements 1 and 2, which extend into each other in a comb-like manner and form a component of a motor vehicle steering mechanism, which is not shown or described in greater detail here. By way of example, the chamber element 1 is attached to a steering column and the chamber element 2 is then attached to a steering shaft. In this case, the end of the steering shaft can be rotated by means of a steering wheel, with the steering shaft being attached in rotary fashion to the steering column, which is fixed to the chassis of the vehicle.

An inductive rotating transmitter is provided between the steering shaft and the steering column. For signal transmission, there is a primary transmitter component 3 on the element 1 and a secondary transmitter component 4 on the element 2, and for energy transmission, there is a primary transmitter component 5 on the element 1 and a secondary transmitter component 6 on the element 2. This makes it possible for measurement data and electrical energy to be transmitted between, for example, sensors disposed on the steering shaft and a central evaluation unit in the vehicle.

The embodiment of the concentric, radial walls of the chamber elements 1 and 2, which extend into each other in a comb-like manner, produces a chamber 7 for signal transmission and a chamber 8 for energy transmission. The production of two transmitters separated by chamber walls that is thus achieved allows the mixture of signal and energy transmission to be prevented in a simple manner.

The invention claimed is:

1. An inductive transmitter system for transmitting measurement data and electrical energy between two components movable relative to each other, the inductive transmitter system comprising one transmitter provided for transmitting measurement data and one transmitter provided for transmitting electrical energy; the transmitters having at least one primary transmitter component and at least secondary transmitter component, the components which are movable in relation to each other extend into each other in a comb-like manner such that separate chambers are formed that are magnetically shielded from each other to a large extent, the chambers being formed on the components by concentric radial metal walls, with the concentric walls extending into each other in such a way that they form the chambers disposed radially one behind the other, respective chamber elements for the components being formed so that they have a double U-shape in a radial cross-section and their concentric walls are arranged so that they extend into each other without hindering a rotational movement.

2. An inductive transmitter system as defined in claim 1, wherein one component is disposable on a steering shaft of a vehicle, and the other component is disposable on steering column of the vehicle.

3. A vehicle, comprising a vehicle part with a steering shaft and a steering column, and an inductive transmitter system for transmitting measurement data and electrical energy between two components movable relative to each other, the inductive transmitter system comprising one transmitter provided for transmitting measurement data and one transmitter provided for transmitting electrical energy; the transmitters having at least one primary transmitter component and at least secondary transmitter component, the components which are movable in relation to each other extend into each other in a comb-like manner such that separate chambers are formed that are magnetically shielded from each other to a large extent, the chambers being formed on the components by concentric radial metal walls, with the concentric walls extending into each other in such a way that they form the chambers disposed radially one behind the other, respective chamber elements for the components being formed so that they have a double U-shape in a radial cross-section and their concentric walls are arranged so that they extend into each other without hindering a rotational movement.

4. A vehicle as defined in claim 3, wherein one component is disposed on the steering shaft, and the other component is disposed on the steering column.

* * * * *